US009605380B2

(12) United States Patent
Uymer et al.

(10) Patent No.: US 9,605,380 B2
(45) Date of Patent: Mar. 28, 2017

(54) PAPERMAKING MACHINE WIRE, THE RUNNING SIDE OF WHICH HAS CROSS THREADS WITH DIFFERENT LENGTHS

(71) Applicant: ANDRITZ KUFFERATH GMBH, Düren (DE)

(72) Inventors: Ipek Uymer, Moenchengladbach (DE); Wolfgang Heger, Nideggen (DE)

(73) Assignee: Andritz Kufferath GmbH, Dueren (DE)

( * ) Notice: Subject to any disclaimer, the term of this patent is extended or adjusted under 35 U.S.C. 154(b) by 0 days.

(21) Appl. No.: 14/995,930

(22) PCT Filed: Jun. 2, 2014

(86) PCT No.: PCT/EP2014/061360
§ 371 (c)(1),
(2) Date: Jan. 14, 2016

(87) PCT Pub. No.: WO2015/018547
PCT Pub. Date: Feb. 12, 2015

(65) Prior Publication Data

US 2016/0215451 A1 Jul. 28, 2016

(30) Foreign Application Priority Data

Aug. 5, 2013 (DE) ..... 10 2013 108 399

(51) Int. Cl.
*D21F 1/00* (2006.01)

(52) U.S. Cl.
CPC ..... *D21F 1/0036* (2013.01); *D21F 1/0045* (2013.01)

(58) Field of Classification Search
CPC ..... D21F 1/00; D21F 1/0045; D21F 1/0036; D03D 3/04; D03D 11/00; D03D 13/00
USPC ..... 162/289
See application file for complete search history.

(56) References Cited

U.S. PATENT DOCUMENTS 4,987,929 A 1/1991 Wilson
5,881,764 A * 3/1999 Ward ..... D21F 1/0045 139/383 A
6,244,306 B1 6/2001 Troughton
6,253,796 B1 7/2001 Wilson et al.
6,354,335 B1 * 3/2002 Taipale ..... D21F 1/0045 139/383 A
2006/0048839 A1 3/2006 Fujisawa
2009/0205740 A1 * 8/2009 Quigley ..... D21F 1/0045 139/408
2012/0145348 A1 6/2012 Pitzler et al.
2015/0337492 A1 * 11/2015 Uymur ..... D21F 1/0045 162/348

FOREIGN PATENT DOCUMENTS

DE 102011083192 3/2013
JP H03-199447 8/1991
JP H08-246373 9/1996
JP 2002-88674 3/2002
JP 2006-57215 3/2006
JP 2006-322108 11/2006

OTHER PUBLICATIONS

International Search Report for underlying PCT/EP2014/061360 issued Jul. 24, 2014.
Office Action issued in the parallel Korean patent application 10-2015-7030596 with English translation, Oct. 2015.

* cited by examiner

*Primary Examiner* — Mark Halpern

(74) *Attorney, Agent, or Firm* — Schlee IP International, P.C.; Alexander R. Schlee

(57) ABSTRACT

A sheet-forming wire with a lower fabric layer formed from a multiplicity of identically constructed lower weave repeats, each of which contains longitudinal threads extending in the lower fabric layer, and lower cross threads, with the lower cross threads extend only in the lower fabric layer. The lower cross threads are tied into the lower fabric layer in each case by exactly two longitudinal threads extending in the lower fabric layer, in that each particular lower cross thread is run under by a first longitudinal thread at a first tying-in point (x) and is run under by a second longitudinal thread at a second tying-in point (x). The lower cross threads form first lower cross threads (I) and second lower cross threads (II). The first lower cross threads form a shorter float on the running side than the second lower cross threads.

15 Claims, 5 Drawing Sheets

A - A

B - B

PAPERMAKING MACHINE WIRE, THE RUNNING SIDE OF WHICH HAS CROSS THREADS WITH DIFFERENT LENGTHS

CROSS REFERENCE TO RELATED APPLICATION

This application is a national phase of the International Application PCT/EP2014/061360 filed Jun. 2, 2014, claiming priority of the German Patent Application DE 10 2013 108 399.4 filed Aug. 5, 2013. The content of this aforementioned document is herewith incorporated by reference.

BACKGROUND OF THE INVENTION

The present invention relates to a paper machine screen.

A paper machine screen may, e.g. be used in/applied to the wet end of a paper machine for draining/filtration of paper fibrous material, thus for forming of the paper sheet (so-called sheet forming screen or forming screen).

A paper machine screen may e.g. be configured as a so-called long floating screen, i.e. as a screen with lower transverse threads having/forming long floats on the running side. Such screens are mainly used for papers with higher grammage. Screens of this kind may generally be used at all speeds with Fourdrinier machines as well as with hybrid-formers or GAP-formers. Screens of this kind are highly regarded due to their long operating time.

In paper machine screens/forming screens, e.g. two different materials, for example polyester and polyamide, may be used on the running side for forming the lower transverse threads. These two materials may, for example, be introduced in a longitudinal direction alternately behind one another on the running side, wherein the polyester is primarily useful for mechanically stabilizing the fabric, while the polyamide is used mainly to increase abrasion resistance and thus for extending the operating time. Both materials have generally different properties which are also reflected in the respective behavior of the threads within the fabric.

Fabrics/Screens are known, in which the lower transverse threads are always bound consistently or all with the same course with respect to the longitudinal threads extending in the lower fabric layer. When using different materials for the lower transverse threads, this may result, for example, in an inconsistent contact of the particular material groups/threads with the paper machine (due to the different behavior of the threads in the fabric), which may negatively affect both the running of the screen and the paper quality. In other words, the selection of the different materials is, in this case, very limited and the materials should be selected in such a way that both materials and the threads formed therefrom, respectively, behave as harmoniously as possible in the total fabric. If the both different threads and materials are badly adjusted, this may, for example, lead to a different projection on the running side by the lower transverse threads.

With fabrics/screens having consistently bound lower transverse threads made from different materials, it is possible to grind the screen level on the running side following its formation (e.g. after weaving and successive thermosetting), in order to reduce/preempt different/inconsistent projection of the lower transverse threads in a downward direction. This, however, will result in loss of material and an uneven running side may reoccur in a wet state.

A fabric is known, for example, from U.S. Pat. No. 6,244,306 B1 (see FIG. 2) or from US 2012/0145348 A1 (see FIG. 1). U.S. Pat. No. 6,244,306 B1 shows a consistent double binding of the lower transverse threads resulting in a long transverse thread float on the running side (a transverse thread float or "transverse-bridge" over seven successive lower longitudinal threads). Both binding positions are respectively separated by (exactly) one lower longitudinal thread extending over the respective lower transverse thread (in a plan view onto the lower fabric layer). US 2012/0145348 A1 too shows a consistent double binding of the lower transverse threads resulting in a long transverse thread float on the running side (a transverse thread float over ten successive lower longitudinal threads), wherein both of the binding positions of the respective transverse thread here are arranged directly next to each other, i.e. are not separated by a longitudinal thread extending over the respective lower transverse thread (in a plan view onto the lower fabric layer).

Illustratively, one aspect of various embodiments can be seen to provide a paper machine screen with a running side that is/can be formed such that it has a long operating time and/or a suitable operating behavior.

Illustratively, one additional or alternative aspect of various embodiments can be seen to provide a paper machine screen with a running side that is/can be formed such that it can ensure high paper quality, especially over a long period of time.

Illustratively, one additional or alternative aspect of various embodiments can be seen to provide a paper machine screen with a running side that is/can be formed such that it has a high mechanical stability and/or high abrasion resistance.

Illustratively, one additional or alternative aspect of various embodiments can be seen to provide a paper machine screen with a running side that is/can be formed consistently, e.g. with a substantially consistent projection of the lower transverse threads.

Illustratively, one additional or alternative aspect of various embodiments can be seen to provide a paper machine screen that can be easily produced.

Illustratively, one additional or alternative aspect of various embodiments can be seen to provide a paper machine screen that can be produced without or with relatively little loss of material.

SUMMARY OF THE INVENTION

The invention provides a paper machine screen according to claim 1. Additional embodiments/configurations of the invention are described in the dependent claims.

DETAILED DESCRIPTION OF THE INVENTION

According to various embodiments the lower transverse threads are, different from the above mentioned prior art, not bound into the lower fabric layer consistently but inconsistently.

According to various embodiments the inconsistent binding of the lower transverse threads can compensate a different behavior of the threads in the fabric (e.g. when different materials have been used for the threads and/or the threads have different thermosetting properties), for example in a manner such that the lower fabric has a substantially geometrically consistent appearance especially on the outer side/running side, particularly with a substantially consistent projection of the lower transverse threads (without the necessity of grinding the running side).

This means, according to various embodiments, a different binding/incorporation of the lower transverse threads can counteract, for example, a different projection resulting from a different shrinking behavior of two lower transverse threads, and/or, for example, lower transverse threads with different diameters may be provided, that still have a substantially consistent projection on the running side, wherein the thicker diameter can be selected, for example, according to a higher required standard concerning stability or anticipated operating time.

In addition or alternatively according to various embodiments, due to a different binding of the lower transverse threads, different materials may be used for the lower transverse threads, said different materials causing the problems in the prior art initially mentioned. The range of suitable different materials for the lower transverse threads is thus enlarged or extended according to various embodiments.

In addition or alternatively according to various embodiments, the seam strength can be increased by means of a modified course of the lower longitudinal thread within the lower fabric.

According to various aspects, a paper machine screen (e.g. sheet forming screen) can be formed as a multi-layer fabric having an upper fabric layer and a lower fabric layer. For example, the multi-fabric layer can consist of the upper fabric layer and the lower fabric layer. The upper fabric layer and the lower fabric layer are connected to each other by means of binding threads (e.g. binding transverse threads).

According to various embodiments, for example, the so-called paper side is formed by the upper side/outer side of the upper fabric layer, whereas the so-called running side is formed by the bottom side/outer side of the lower fabric layer. A multi-layer configuration hereby allows for a different configuration of the paper side and running side according to various embodiments, so that both sides are/can be adapted to the respective intended purpose. For example, the longitudinal threads, realizing the circulation of the screen according to various embodiments, may be protected against wear on the running side by significantly projecting or protruding transverse threads. On the paper side, for example by providing a balanced ratio of longitudinal threads and transverse threads, a good depositing possibility for the paper fibers can be ensured. With respect to the fiber support, but also with respect to the tendency to marking of the screen, the simplest and at the same time the oldest basic weave of textile engineering has proven of value for the upper fabric and thus for the paper side, namely the so-called plain weave. Although the plain weave is very well suited for forming a paper sheet and is hence very well suited for the paper side, it is usually not suited very well for the machine side. If a paper machine screen is provided with a plain weave paper side, it can therefore be advisable to provide a second fiber layer underneath the plain weave, forming the machine side of the screen, which gives the screen sufficient stability and wearing potential.

The upper fabric layer as well as its binding to the lower fabric layer are not limited to a certain configuration and may be selected according to the respective requirements/case of application. Possible examples of configuration, which are in no way to be understood as limiting, are mentioned below.

The lower fabric layer has (e.g. consists of) a plurality of uniformly structured lower weave repeats, each of which comprising (e.g. consisting of):

- longitudinal threads (e.g. formed as lower longitudinal threads) extending in the lower fabric layer and
- lower transverse threads extending exclusively in the lower fabric layer and being interwoven with the longitudinal threads that extend in the lower fabric layer (e.g. thereby completely forming the lower weave).

At least the lower transverse threads are hence formed as threads that remain/extend exclusively in one fabric layer (namely the lower fabric layer). The longitudinal threads extending in the lower fabric layer can basically be formed as alternating threads (e.g. in the form of so called functional longitudinal thread pairs) and/or as threads remaining/extending exclusively in one fabric layer, i.e. as lower longitudinal threads. For example, all structuring threads of the lower fabric (i.e. contributing to the forming of the weave of the lower fabric) extending in a transverse direction can be formed as lower transverse threads.

In the respective lower weave repeat the lower transverse threads are each bound into the lower fabric layer by exactly two longitudinal threads extending in the lower fabric layer as a first longitudinal thread extends under the respective lower transverse thread at a first binding position and a second longitudinal thread extends under the respective lower transverse thread at a second binding position (in a plan view onto the top side/inner side of the lower fabric layer, i.e. in a plan view onto the side of the lower fabric layer facing away from the running side). This means that every lower transverse thread is bound in/integrated twice in the lower weave repeat.

Further, in the respective lower weave repeat the lower transverse threads are bound into the lower fabric layer differently, thereby forming first lower transverse threads and second lower transverse threads, wherein at the first lower transverse threads a shortest distance in transverse direction between the first and the second binding position is larger than at the second lower transverse threads so that the first lower transverse threads form a shorter float on the running side than the second lower transverse threads.

According to various embodiments, the shortest distance in transverse direction between the first and the second binding position for each first lower transverse thread can, for example, be substantially equal in size and the shortest distance in transverse direction for each second lower transverse thread can also be substantially equal in size. The same applies for the floats, i.e. the floats of the first lower transverse threads can be substantially equal in size/length and the floats of the second lower transverse threads can also be substantially equal in size/length.

According to various embodiments, the screen can, for example, be formed as a long floating screen with lower transverse threads that all form/have long floats on the running side. That is, each lower transverse thread then forms on the running side within the lower weave repeat a long transverse thread-float or transverse thread-bridge extending over more than half of the longitudinal threads with which the respective lower transverse thread is interwoven or under or over which the respective lower transverse thread extends in the lower fabric within the lower weave repeat.

According to various embodiments, the float on the running side of each lower transverse thread in the lower weave repeat can, for example, also be referred to as longest or longer distance in transverse direction between the first and second binding position. In this case, counting/measuring is performed in transverse direction beyond the edge of the lower weave repeat, as further weave repeats may (directly) follow to the left and to the right of the lower weave repeat. For example, for each lower transverse thread the shortest distance is smaller than the longer distance, such that all lower transverse threads have/form long floats on the running side.

According to various embodiments, the larger shortest distance in transverse direction at the first lower transverse threads can, for example, be achieved by the fact that at the first lower transverse threads between the first and the second binding position at least one longitudinal thread extending in the lower fabric layer and running over the lower transverse thread (especially in a plan view onto the upper side/inner side of the lower fabric layer, that is, in a plan view onto the side facing away from the running side) more is arranged than at the second lower transverse threads. Here a case should be included and incorporated, where at the first lower transverse threads between the first and second binding position only one and hence at the second lower transverse threads none longitudinal thread, extending in the lower fabric layer and over the lower transverse thread, is provided; see below. For example, there can be exactly one longitudinal thread more or exactly two longitudinal threads more being arranged at each of the first lower transverse threads (or exactly one or exactly two "additional" longitudinal threads, respectively).

According to various embodiments, the number of longitudinal threads extending in the lower fabric layer, that extend over the respective transverse thread between the first and the second binding position, may hence be different at the first lower transverse threads from the corresponding number at the second lower transverse threads.

According to various embodiments, at the first lower transverse threads the shortest distance in a transverse direction—expressed by longitudinal threads positioned therebetween, extending in the lower fabric layer and extending over the lower transverse thread—is, for example, one longitudinal thread or two longitudinal threads, wherein at the second lower transverse threads the shortest distance—expressed by longitudinal threads positioned therebetween, extending in the lower fabric layer and extending over the lower transverse thread—is zero longitudinal threads or one longitudinal thread (in a plan view onto the top side of the lower fabric layer).

According to various embodiments, in the lower weave repeat at the first lower transverse threads, for example, respectively exactly one longitudinal thread, extending in the lower fabric layer and extending over the lower transverse thread, can be arranged between the first and the second binding position, wherein in the lower weave repeat at the second lower transverse threads between the first and the second binding position, no longitudinal thread, extending in the lower fabric layer and extending over the lower transverse thread, is arranged respectively so that both binding positions are located immediately adjacent to each other.

According to various embodiments, the different shortest distance in transverse direction can, for example, be/is achieved/obtained by the fact that the first lower transverse threads are introduced/bound into the lower fabric layer with a course (or a binding pattern or overlapping pattern, respectively) different from the second lower transverse threads with respect to the longitudinal threads extending in the lower fabric layer, wherein all of the first lower transverse threads have, in principle, the same course and only the arrangement of the binding positions in transverse direction varies (i.e., for example, a so-called "pitch" of the binding pattern being neglected), and wherein all of the second lower transverse threads have, in principle, the same course and only the arrangement of the binding positions varies in transverse direction. Such a course may, for example, indicate under or over how many longitudinal threads the respective lower transverse thread extends in the lower weave repeat and at what sequence this takes place. A course of the first lower transverse threads with respect to the longitudinal threads extending in the lower fabric layer may, for example, be as follows: under seven successive longitudinal threads, over one longitudinal thread, under one longitudinal thread and over one longitudinal thread (in a plan view onto the top side of the lower fabric layer). A course of the second lower transverse threads with respect to the longitudinal threads extending in the lower fabric layer may, for example, be as follows: under eight successive longitudinal threads and over two successive longitudinal threads. Counting is performed here in transverse direction beyond the edge of the repeat. The respective "starting point" or the binding positions, respectively, may, as stated before, vary in transverse direction.

According to various embodiments, in the lower weave repeat the binding positions of a respective first lower transverse thread can be arranged, for example, offset in a transverse direction to the binding positions of the two first lower transverse threads adjacently arranged in longitudinal direction, for example, offset to the binding positions of every other first lower transverse thread of the lower weave repeat.

According to various embodiments, in the lower weave repeat the binding positions of a respective second lower transverse thread can be arranged, for example, offset in a transverse direction to the binding positions of the two second lower transverse threads adjacently arranged in transverse direction, for example, offset to the binding positions of every other second lower transverse thread of the lower fabric layer.

According to various embodiments, in the lower weave repeat the binding positions of two first lower transverse threads, arranged directly next to each other in longitudinal direction, can, for example, be arranged offset in a transverse direction always by the same amount of longitudinal threads extending in the lower fabric layer and in the same direction (i.e. with a constant pitch).

According to various embodiments, in the lower weave repeat the binding positions of two second lower transverse threads, arranged next to each other in longitudinal direction, can, for example, be arranged offset in a transverse direction always by the same amount of longitudinal threads extending in the lower fabric layer and in the same direction.

For example, the pitch in the case of 10 lower longitudinal threads per lower weave repeat for the first lower transverse threads can be "three longitudinal threads to the left" (in a plan view onto the top side of the lower fabric layer). For example, the pitch in the case of 10 lower longitudinal threads per lower weave repeat for the second lower transverse threads can also be "three longitudinal threads to the left" (in a plan view onto the top side of the lower fabric layer).

According to various embodiments, the ratio of first lower transverse threads to second lower transverse threads in the lower weave repeat can, for example, be 1:1, for example at a directly alternating arrangement in longitudinal direction, or 2:1, for example at a repeating sequence in longitudinal direction of two first lower transverse threads, arranged directly adjacent to each other, and one following second lower transverse thread, or 1:2, for example at a repeating sequence in longitudinal direction of one first lower transverse thread and two following second transverse threads, arranged directly adjacent to each other.

According to various embodiments the first lower transverse threads can, for example, have thermosetting properties different from those of the second lower transverse threads, for example have a different shrinking behavior than the second lower transverse threads.

According to various embodiments, the different float-length of the first lower transverse threads and the second lower transverse threads on the running side can take into account or counteract and, e.g. substantially compensate, for example a different thermosetting behavior, e.g. shrinking behavior. In other words, according to various embodiments the thermosetting properties of the first lower transverse threads and the second lower transverse threads are/can be selected/set such that a difference in projection of the lower transverse threads on the running side, resulting from the different float-length, is/can be compensated or at least is/can be reduced by the different thermosetting properties.

According to various embodiments, the first lower transverse threads may, for example, have a cross sectional shape and/or a diameter different from the second lower transverse threads, and/or the first lower transverse threads may be made of a material different from the material of the second lower transverse threads, and/or the first lower transverse threads and the second lower transverse threads may be treated differently with influence on their thermosetting behavior, for example, differently mechanically treated, e.g. differently stretched. Different materials can, for example, mean a material pair of: polyamide and polyester, or a first polyamide (e.g. PA 6.6) and a second polyamide (e.g. PA 6.10 or PA 6.12 or PA 10 or PA 12), or a first polyester and a second polyester different from the first polyester. According to the latter alternative (different treatment), polyester may be used, for example, for both the first and the second lower transverse threads, wherein the first lower transverse threads are being stretched differently during their production than the second lower transverse threads.

According to various embodiments, the different cross sectional shape and/or the different diameter and/or the different material and/or the different treatment can, for example, result in the above-mentioned different thermosetting properties.

For example in the case of different diameters, the lower transverse threads can also substantially have the same thermosetting properties, and/or a screen can be provided that is not thermoset. According to various embodiments, the different float-length of the first lower transverse threads and second lower transverse threads on the running side may, for example, be selected such that it counteracts and at least partially, for example substantially completely compensates a different projection on the running side resulting from the different diameters. In other words, according to various embodiments the diameter of the first lower transverse threads and the diameter of the second lower transverse threads can, for example, be selected such that a difference in the projection of the lower transverse threads on the running side resulting from the different float-length, is/will be compensated or at least reduced by the different diameters.

According to various embodiments, the paper machine screen can for example be formed as a synthetic fabric, for example, as a thermoset synthetic fabric, with at least the lower transverse threads being formed as synthetic threads, for example, also the longitudinal and transverse threads extending in the upper fabric layer as well as the longitudinal threads extending in the lower fabric layer.

According to various embodiments, a respective lower transverse thread/synthetic thread can, for example, be made of polyamide or of polyester. For example, the first lower transverse threads can be made of one of polyamide and polyester, whereas the second transverse threads are made of the other of polyamide and polyester. That is to say that, for example, the first lower transverse threads can be made of PA, whereas the second lower transverse threads are made of polyester (or vice versa).

According to various embodiments, the paper machine screen can, for example, be formed as a transverse thread-bound multi-layer fabric, in which the binding threads are formed from transverse threads. For example, the binding between the upper and lower fabric layer can be performed exclusively by transverse threads. The invention is, however, not limited to this and the binding of the upper and lower fabric layer can, for example, additionally or alternatively be performed with longitudinal threads.

According to various embodiments, the binding threads can, for example, be formed from transverse threads extending in the upper fabric layer and, on the one hand contributing to forming the upper weave and, on the other hand, descending in sections into the lower fabric layer to extend under at least one of the longitudinal threads extending in the lower fabric layer and thereby bind the lower fabric layer to the upper fabric layer. For example, the binding transverse threads only contribute to completing/forming the upper weave and not to completing/forming the lower weave. The invention, however, is not limited thereto and the binding of the upper and lower fabric layer can, for example, additionally or alternatively be performed by separate, pure binding threads that neither in the upper nor in the lower fabric layer contribute to the forming of the respective binding.

According to various embodiments, the longitudinal threads extending in the lower fabric layer can, for example, be formed as lower longitudinal threads (completely or partially), extending exclusively in the lower fabric layer and, for example, being interwoven with the lower transverse threads, thereby completely forming the lower weave.

According to various embodiments, the respective lower weave repeat may, for example, comprise at least 8 longitudinal threads, extending in the lower fabric layer, for example exactly 8 or exactly 10 or exactly 12, for example exactly 8 or exactly 10 or exactly 12 lower longitudinal threads. This may, according to various embodiments, facilitate the forming of long transverse thread-floats on the running side.

According to various embodiments, the ratio of lower transverse threads to longitudinal threads, extending in the lower fabric layer, for example lower longitudinal threads, can e.g. be 2:1, for example exactly 16:8 or exactly 20:10 or exactly 24:12.

According to various embodiments, when seen in a longitudinal direction, in the lower weave repeat always a transverse thread-binding to the upper fabric layer can be provided between two lower transverse threads arranged immediately next to each other, for example formed by exactly one binding transverse thread extending temporarily in the lower fabric layer and thereby extending under at least one or exactly one longitudinal thread extending in the lower fabric layer.

According to various embodiments, the diameter of the lower transverse threads can, for example, be larger than the diameter of the transverse threads extending in the upper fabric layer and/or larger than the diameter of the binding threads, and/or the diameter of the lower transverse threads can, for example, be larger than the diameter of the longitudinal threads extending in the lower fabric layer, for example of the lower longitudinal threads, and/or the lower transverse threads can, for example, have the largest diameter of all threads in the total repeat.

As initially mentioned, the upper fabric layer is not limited to a certain configuration and a suitable paper side may be used for the respective purpose.

According to various embodiments, the fabric may, for example, have such a total repeat comprising exactly one lower weave repeat and one or more upper weave repeats. The above given information concerning the lower weave repeat shall then also apply in the same way for the total repeat.

According to various embodiments the upper fabric layer can, by way of example, be formed from (e.g. consist of) a plurality of uniformly structured upper weave repeats, each of which comprises (e.g. consists of):

- upper longitudinal threads extending exclusively in the upper fabric layer,
- upper transverse threads extending exclusively in the upper fabric layer and being interwoven with the upper longitudinal threads, thereby partially forming the upper weave, and
- binding transverse threads that, on the one hand, complete the upper weave and, on the other hand, descend in sections into the lower fabric layer to extend under at least one longitudinal thread extending in the lower fabric layer and thereby bind the lower fabric layer to the upper fabric layer.

According to various embodiments, the fabric can have, for example, a total repeat in which the ratio of upper longitudinal threads to lower longitudinal threads is 1:1, for example exactly 8:8 or exactly 10:10 or exactly 12:12.

According to various embodiments, the upper fabric layer can, for example, be formed with a plain weave which can, for example, be formed from upper longitudinal threads being interwoven with upper transverse threads as well as with imaginary continuous upper transverse threads provided by functional transverse thread pairs, wherein, for example, in longitudinal direction successively alternating one upper transverse thread and one functional transverse thread pair are arranged on the paper side. One or both transverse threads of a functional pair may be formed as binding transverse threads.

According to various embodiments, the term longitudinal threads refers to threads of the screen/fabric that extend in a longitudinal direction or longitudinal extension, of the screen. According to various embodiments, the longitudinal threads may, during operation, be arranged in a running direction of the paper machine. The respective longitudinal thread can, according to various embodiments, thus for example be referred to as running direction-thread or machine direction-thread (i.e. MD-thread for "machine direction"). For example, the respective longitudinal thread is formed as a warp thread.

Additionally or alternatively, according to various embodiments, the term transverse thread refers, for example, to threads of the screen/fabric that extend in a transverse direction of the screen. According to various embodiments, the transverse threads can be arranged across the running direction of the paper machine during operation. The respective transverse thread may therefore, according to various embodiments, also be referred to as cross machine direction-thread (i.e. CMD-thread for "cross machine direction"). For example, the respective transverse thread is formed as a weft thread.

Additionally or alternatively, according to various embodiments, a fabric layer can be understood as a one layer-fabric comprising or consisting of interwoven transverse and longitudinal threads.

Additionally or alternatively, according to various embodiments, the upper side (or the outward facing side, respectively) of the upper fabric or the upper fabric layer, respectively, can form the paper side of the screen on which the paper fiber layer is formed. The upper layer can, for example, be a fabric layer which is formed (particularly) fine. For example, the weave of the upper fabric layer is a plain weave.

Additionally or alternatively, according to various embodiments, the lower side (or the outward facing side, respectively) of the lower fabric or the lower fabric layer, respectively, can form the running side of the screen which is in direct contact with the driving elements and draining elements of the paper machine that cause wear. The lower fabric may, for example, be a fabric layer that is formed (particularly) robust. For example, the weave of the lower fabric layer is a weave having long transverse thread-floats on the running side. A long transverse thread-float is understood to be, for example, a float over more than half of the longitudinal threads extending in the lower fabric layer, i.e. at 8 lower longitudinal threads per weave repeat, for example, a float over at least 5 successive lower longitudinal threads.

Additionally or alternatively, according to various embodiments, upper longitudinal threads can be threads that extend exclusively in the upper fabric and are there interwoven with transverse threads extending in the upper fabric, thus not leaving the upper fabric and not changing into the lower fabric, respectively.

Additionally or alternatively, according to various embodiments, upper transverse threads can be threads that extend exclusively in the upper fabric and are there interwoven with longitudinal threads (e.g. upper longitudinal threads) extending in the upper fabric, thus not leaving the upper fabric and not changing into the lower fabric, respectively.

For example, according to various embodiments, upper transverse threads and upper longitudinal threads may together partially form the weave of the upper fabric layer (=first or upper weave), said weave being completed by binding transverse threads (see below).

Additionally or alternatively, according to various embodiments, lower longitudinal threads can be threads that are situated exclusively in the lower fabric and are there interwoven with transverse threads extending in the lower fabric, thus not leaving the lower fabric and not changing into the upper fabric, respectively.

Additionally or alternatively, according to various embodiments, lower transverse threads can be threads that are situated exclusively in the lower fabric and are there interwoven with longitudinal threads (e.g. lower longitudinal threads) extending in the lower fabric, thus not leaving the lower fabric and not changing into the upper fabric, respectively.

For example, according to various embodiments, lower transverse and lower longitudinal threads may together completely form the weave of the lower fabric layer.

Additionally or alternatively, according to various embodiments, binding transverse threads can be threads extending both in the upper fabric layer and in the lower fabric layer thus binding the lower fabric layer to the upper fabric layer.

Additionally or alternatively, according to various embodiments, a functional transverse thread pair can be formed by two transverse threads arranged immediately next to each other, wherein the two transverse threads of a functional transverse thread pair together form on the paper side a virtually (uninterrupted) upper transverse thread that integrates/fits into the binding pattern of the upper fabric layer, i.e. they alternately complete the first weave while each is extending over one or a plurality of upper longitudinal threads or longitudinal threads extending in the upper fabric layer, respectively. Those thread portions of the functional pair which are currently not required for forming the virtually uninterrupted transverse thread on the paper side can be used for binding the lower fabric to the upper fabric. In this respect, either both transverse threads or only one transverse thread of a respective functional transverse thread pair may be formed as binding transverse threads.

Additionally or alternatively, according to various embodiments, the total weave repeat of the fabric may be a recurring binding pattern/thread overlapping pattern of the entire fabric (including upper and lower fabric), especially the smallest repeating unit in the entire fabric, wherein the course of all threads (e.g. upper and lower longitudinal threads, upper and lower transverse threads, binding transverse threads) is being taken into consideration, especially the course of the respective thread in all/both layers. According to various embodiments, knowing the total repeat, the complete fabric or screen may thus be produced. That is to say, the screen or fabric may consist of a plurality of total repeats directly strung together.

Additionally or alternatively, according to various embodiments the weave repeat of the upper fabric or the so-called upper weave repeat may be a recurring pattern or a repeating unit in the upper fabric, especially the smallest repeating unit in the upper fabric. In a plan view onto the upper fabric or the paper side of the screen, a plurality of such upper weave repeats can be seen in the longitudinal and transverse directions of the screen. The upper weave repeat can, for example, thus represent (especially also when considering the changing positions of the functional pairs, if existing) the recurring overlapping pattern of the upper fabric formed in the plan view of the upper fabric by the upper longitudinal threads, upper transverse threads and binding transverse threads (if structuring). In other words, the upper weave repeat can regard the course of the upper transverse threads and binding transverse threads with respect to the upper longitudinal threads and the therefrom resulting overlapping pattern, wherein the course of the binding transverse threads with respect to the lower longitudinal threads is of no importance for determining the upper weave repeat. When, for the respective functional transverse thread pair, considering only the virtual/imaginary transverse thread formed by said functional transverse thread pair (without considering the changing position(s)), one receives the so-called virtual/imaginary upper weave repeat that, for example, can be realized as a plain weave.

Additionally or alternatively, according to various embodiments, the weave repeat of the lower fabric or the lower weave repeat may be a recurring pattern or a repeating unit in the lower fabric, e.g. the smallest repeating unit in the lower fabric. In a plan view onto the top side of the lower fabric layer or the running side of the screen, a plurality of such lower weave repeats can be seen in a longitudinal direction and a transverse direction of the screen, for example immediately adjacent to each other. The lower weave repeat can hence represent (especially without considering the binding positions by the binding transverse threads as they normally do not contribute to forming the second, lower weave) the recurring overlapping pattern of the lower fabric formed in the plan view onto the top side of the lower fabric layer or the running side of the screen by the lower transverse threads and the longitudinal threads extending in the lower fabric layer (e.g. lower longitudinal threads). In other words, the lower weave repeat can regard the course of the lower transverse threads with respect to the longitudinal threads extending in the lower fabric layer (e.g. lower longitudinal threads) and the therefrom resulting overlapping pattern, wherein the course of the binding transverse threads in the lower fabric is of no importance for determining the lower weave repeat.

BRIEF DESCRIPTION OF THE DRAWINGS

Various exemplary embodiments will hereinafter be described in more detail with reference to the drawings. In the drawings in schematic representation:

FIG. 2 shows the upper weave repeat in a plan view onto the top side of the upper fabric layer (=paper side of the screen), wherein the lower fabric layer has been cut off to improve depiction.

FIG. 3 shows the lower weave repeat in a plan view onto the top side of the lower fabric layer (=side of the screen facing away from the running side) with the upper fabric layer having been cut off.

FIG. 4 shows again the lower weave repeat, here in a bottom view onto the bottom side of the lower fabric layer or the running side of the screen, respectively.

In the FIGS. 2 to 6, threads extending from top to bottom are longitudinal threads and threads extending from left to right are transverse threads.

Figure 1:
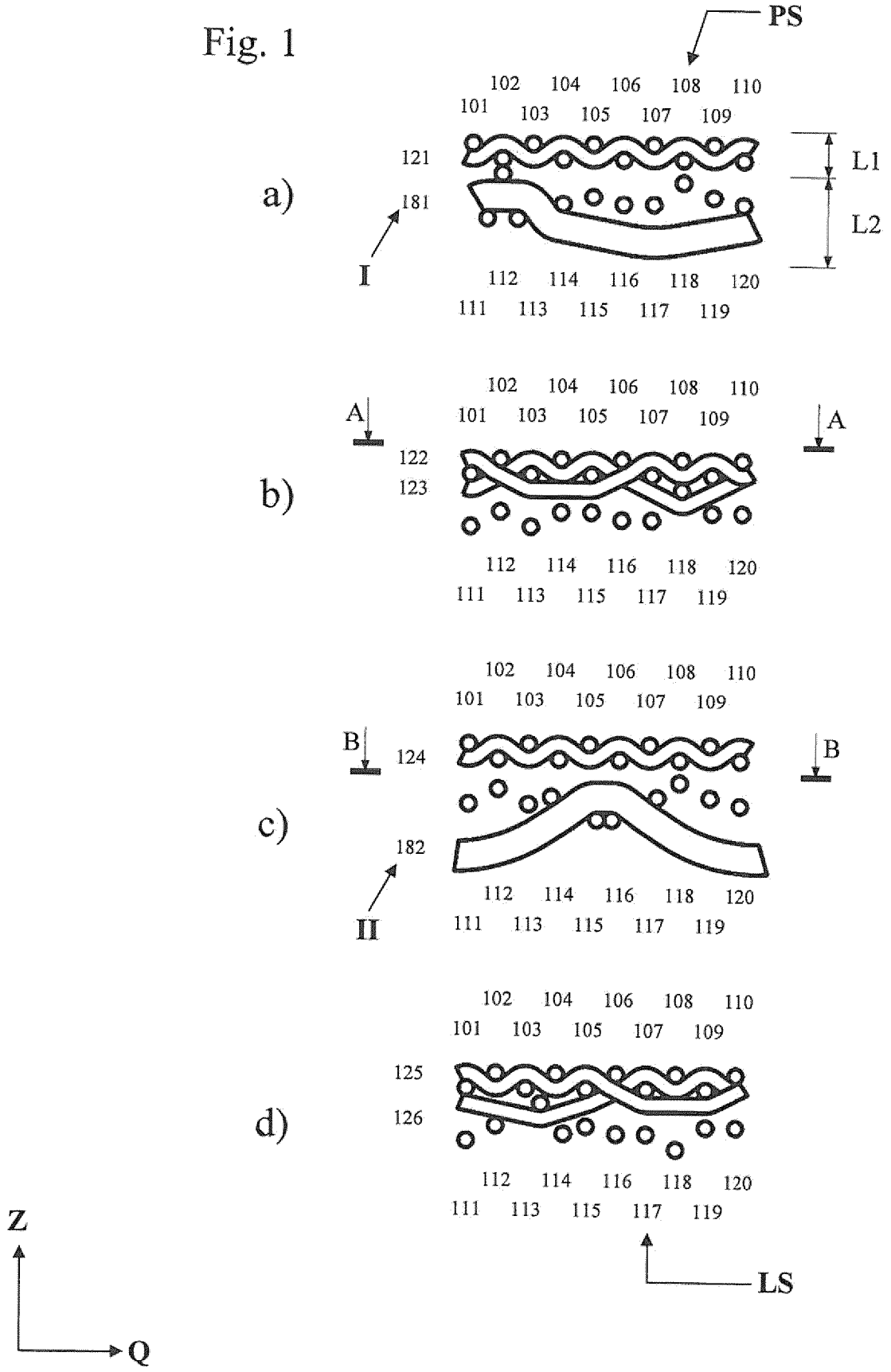
FIGS. 1 to 4 show a paper machine screen formed as a multi-layer fabric, especially sheet forming screen (or forming screen), according to a first embodiment (so-called 10-shaft configuration), wherein FIGS. 1*a*)-1*d*) represent various cross sections through the total repeat of the fabric, wherein the comparatively wide binding of the lower transverse thread 181 and the comparatively narrow binding of the lower transverse thread 182 can be seen, which results in a comparatively short float-length for the thread 181 and a comparatively long float-length for the thread 182.

In the FIGS. 1*a*) to 1*d*) the longitudinal threads are shown with a circular appearance (they extend perpendicularly to the paper plane and towards the viewer) and the transverse threads again extend from the left to the right.

In the Figures identical or similar elements have identical references, where appropriate.

DETAILED DESCRIPTION OF THE DRAWINGS

In the below detailed description reference is made to the accompanying drawings which form a part thereof and in which, by way of illustration, specific embodiments are being shown in which the invention may be practiced. In this regard directional terminology, such as "top," "bottom," "front," "back," "leading," "trailing," etc. is used with reference to the orientation of the Figure(s) being described. Because components of embodiments can be positioned in a number of different orientations, the directional terminology is used for purposes of illustration and is in no way limiting.

It is to be understood that other embodiments may be utilized and structural or logical changes may be made without departing from the scope of the present invention. It is to be understood that features of the various exemplary embodiments described herein may be combined with each other, unless specifically indicated otherwise. The following detailed description is therefore not to be taken in a limiting sense with the scope of the present invention being defined by the appended claims.

FIGS. 1 to 4 show a paper machine screen/sheet forming screen (below referred to as "screen") formed as a multi-layer fabric, according to a first embodiment of the invention.

As can be seen, for example, in FIGS. 1*a*) to 1*d*), the screen is formed as a multi-layer fabric with an upper fabric layer L1 and a lower fabric layer L2 that are connected to each other by means of binding threads (see transverse thread 123 in FIG. 1*b*) as well as the transverse thread 126 in FIG. 1*d*)). The paper side PS of the screen is formed by the upper fabric layer L1, whereas the running side LS of the screen is formed by the lower fabric layer L2.

The lower fabric layer L2 is formed by a plurality of uniformly structured lower weave repeats (and consists, for example, of those) each of which containing longitudinal threads 111-120 extending in the lower fabric layer L2 and lower transverse threads 181-200 (e.g. the respective repeat consists of said threads) that extend exclusively in the lower fabric layer L2 and which are interwoven with the longitudinal threads 111-120 extending in the lower fabric layer.

As shown in the Figures, the longitudinal threads extending in the lower fabric layer can, for example, be formed as lower longitudinal threads 111-120 extending exclusively in the lower fabric layer L2 and, for example, being interwoven with the lower transverse threads 181-200 thereby completely forming the lower weave. Hence reference is made below to lower longitudinal threads, even though the longitudinal threads 111-120 extending in the lower fabric layer can also be configured differently.

Figure 3:
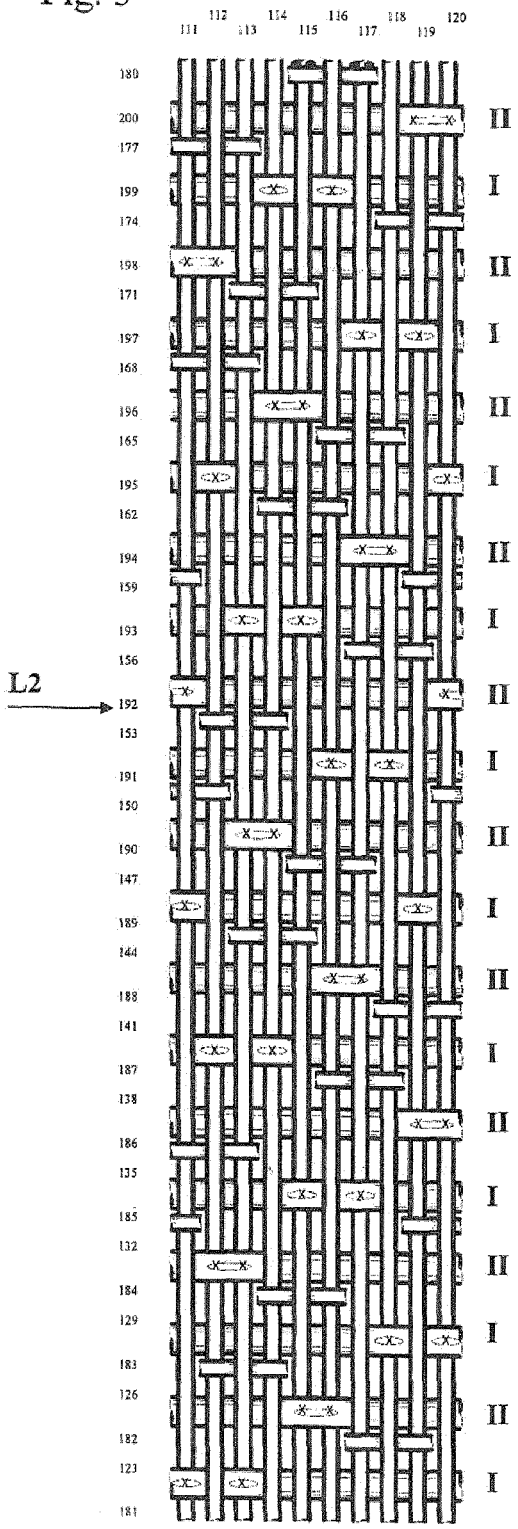

As shown in FIG. 3, in the lower weave repeat the lower transverse threads 181-200 are each bound into the lower fabric layer by exactly two longitudinal threads 111-120 as a first longitudinal thread 111, 115, . . . extends under the respective lower transverse thread 181, 182, . . . at a first binding position "x" and a second longitudinal thread 133, 116, . . . extends under the respective lower transverse thread 181, 182, . . . at a second binding position "x". For example, the longitudinal thread 111 extends under the lower transverse thread 181 at a first binding position "x" and the longitudinal thread 113 extends under the lower transverse thread 181 at a second binding position "x" (see also FIG. 1*a*)). Figuratively speaking thread 181 cannot fall downward out of the fabric/screen due to it being bound in twice. The longitudinal thread 115, however, extends under the lower transverse thread 182 at a first binding position "x" and the longitudinal thread 116 extends under the lower transverse thread 182 at a second binding position "x" (see also FIG. 1*c*)).

Figure 4:
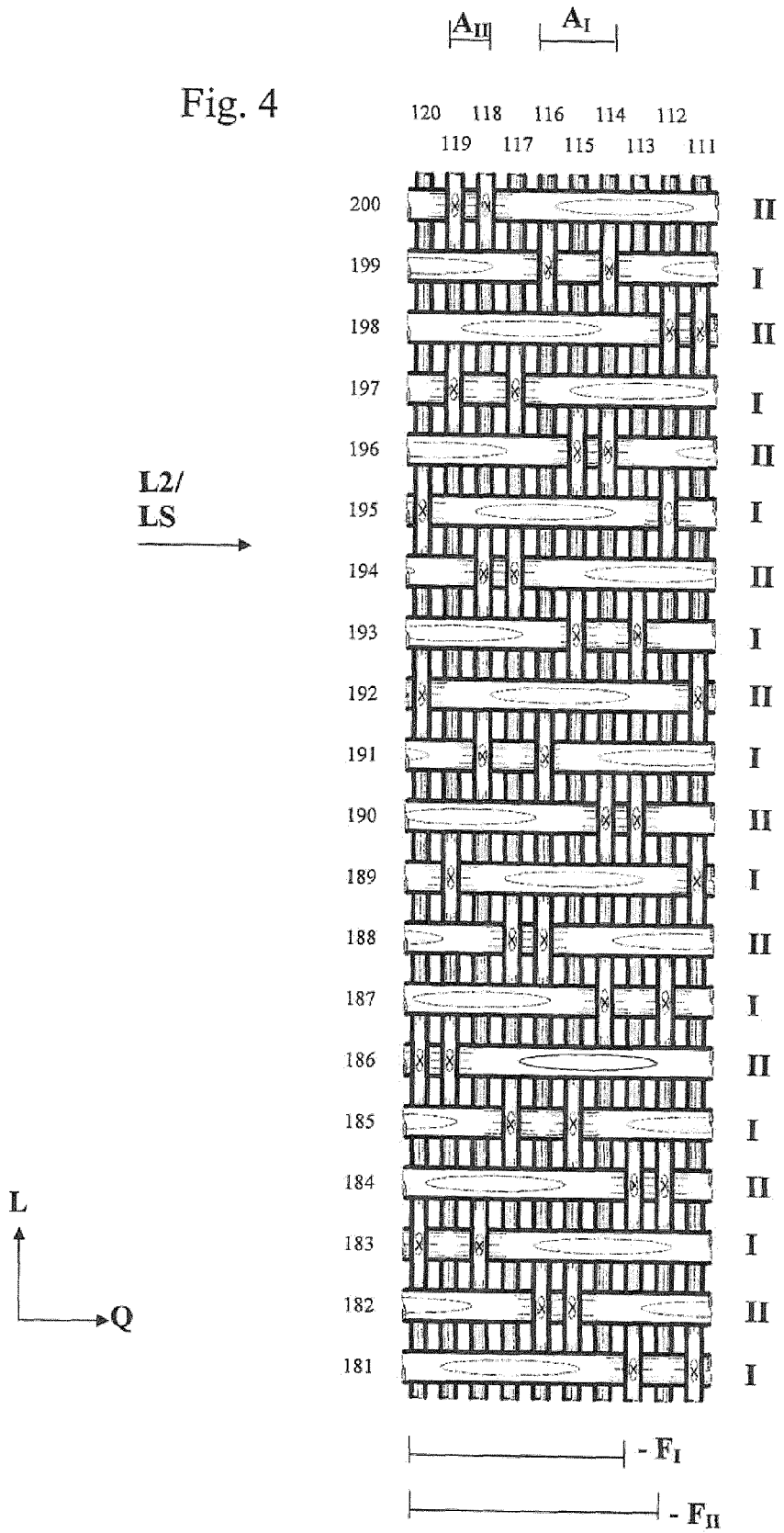

As can be further seen in FIG. 3, in the respective lower weave repeat the lower transverse threads 181-200 are bound into the lower fabric layer differently, thereby forming first lower transverse threads I and second lower transverse threads II, wherein at the first lower transverse threads I a shortest distance (see also FIG. 4: distance $A_I$) in transverse direction Q between the first and the second binding position x is larger than at the second lower transverse threads II (see FIG. 4: distance $A_{II}$)

As shown in FIG. 4, the different binding has the result that the first lower transverse threads I form on the running side LS a shorter float $F_I$ than the second lower transverse threads II whose float in FIG. 4 is designated $F_{II}$. The float can, for example, be understood/referred to as the longest transverse thread-portion extending on the running side over an amount of successive lower longitudinal threads (i.e. between two binding positions). At the repeat in FIG. 4, counting/measuring is performed beyond the edge as, according to this embodiment, in transverse direction to the right and to the left respectively one further repeat is arranged directly next to the repeat shown. The float $F_1$ is particularly easy to recognize for the thread 181 and the float $F_{II}$ is particularly easy to recognize for the thread 198. As shown, the float at the first lower transverse threads may, according to various embodiments, extend over seven lower longitudinal threads, whereas the float at the second lower transverse threads may extend over eight lower longitudinal threads.

The different shortest distance as well as the different float-length resulting therefrom are also indicated in FIGS. 1*a*) and 1*c*). From those images it can also be seen that the different float or the different binding of the lower transverse threads, respectively, may initially/generally result in a different "sagging" of the lower transverse threads which, in turn, may cause a different projecting of the lower transverse threads on the running side.

According to various embodiments, this situation is used, however, to at least partially compensate, e.g., a different behavior or different properties of the first and second lower transverse threads in the fabric, and/or to be able to accommodate different diameters and/or materials in the lower fabric. It is, for example, possible to have the transverse thread in FIG. 1*c*) that hangs further downward, shrunk more during a thermosetting of the screen than the transverse thread of FIG. 1*a*) that does not hang down that far.

As can be seen in FIG. 3 (see also FIGS. 1*a*) and 1*c*)), the larger shortest distance $A_I$ in transverse direction Q at the first lower transverse threads I can, for example, be achieved by the fact that at the first lower transverse threads between the first and the second binding position x at least one longitudinal thread 111-120 more, extending over the lower transverse thread, is arranged than at the second lower transverse threads II, for example, exactly one longitudinal thread more or one additional longitudinal thread, respectively.

As can further be seen in FIG. 3 (see also FIGS. 1*a*) and 1*c*)), at the first lower transverse threads I the shortest distance $A_I$ in transverse direction Q—expressed by lower longitudinal threads 111-120 positioned therebetween, extending over the lower transverse thread—can, for example be exactly one longitudinal thread, wherein at the second lower transverse threads II the shortest distance $A_{II}$—expressed by lower longitudinal threads 111-120 positioned therebetween, extending over the lower transverse thread—is zero longitudinal threads.

This means, in the lower weave repeat at the first lower transverse threads I between the first and the second binding position x, exactly one lower longitudinal thread 111-120, extending over the lower transverse thread, can be arranged, wherein in the lower weave repeat at the second lower transverse threads II between the first and the second binding position x no lower longitudinal thread 111-120, extending over the lower transverse thread, is arranged respectively so that both binding positions are located immediately adjacent to each other.

As can further be seen in FIG. 3 (see also FIGS. 1*a*) and 1*c*)), the different shortest distance in transverse direction Q may, for example, be achieved by the fact that first lower transverse threads I are introduced/interwoven into the lower fabric layer with a course different from the second lower transverse threads II with respect to the lower longitudinal threads 111-120, wherein all of the first lower transverse threads I in the lower weave repeat have, in principle, the same course and only the arrangement of the binding positions x in transverse direction Q varies, and wherein all of the second lower transverse threads II in the lower weave repeat have, in principle, the same course and only the arrangement of the binding positions x in transverse direction Q varies.

As can be seen in FIG. 3 (see also FIGS. 1*a*) and 1*c*)), the course of the first lower transverse threads I with respect to the lower longitudinal threads can, for example, be as follows: under seven successive longitudinal threads, over one longitudinal thread, under one longitudinal thread and over one longitudinal thread. The course of the second lower transverse threads II with respect to the lower longitudinal threads can, for example, be as follows: under eight successive longitudinal threads, and over two successive longitudinal threads. In this matter, counting is performed respectively in transverse direction beyond the edge of the lower repeat. The respective "starting point" or the binding positions, respectively, may, as mentioned before, vary in transverse direction; this does not change the above described basic course of the transverse threads with respect to the lower longitudinal threads.

As can be seen in FIG. 3, in the lower weave repeat the binding positions x of a respective first lower transverse thread I may be, for example, arranged offset in a transverse direction to the binding positions of the two first lower transverse threads adjacently arranged in longitudinal direction L, for example offset to the binding positions of every other first lower transverse thread of the lower weave repeat. See, e.g. the first lower transverse thread 183 and the two first lower transverse threads 181 and 185 arranged adjacently in longitudinal direction L.

As can also be seen in FIG. 3, in the lower weave repeat the binding positions x of a respective second lower transverse thread II may also be arranged offset in a transverse direction to the binding positions of the second lower transverse threads adjacently arranged in longitudinal direction L, for example offset to the binding positions of every other second lower transverse thread of the lower weave repeat. See, for example the second lower transverse thread 184 and the two second lower transverse threads 182 and 186 arranged adjacently in longitudinal direction L.

As can be seen in FIG. 3, in the lower weave repeat the binding positions x of two first lower transverse threads I, arranged directly next to each other in longitudinal direction L, may be arranged offset in a transverse direction always by the same amount of longitudinal threads 111-120 extending in the lower fabric layer and in the same direction. The same holds true for the second lower transverse threads. In FIG. 3*a* pitch of "three lower longitudinal threads to the left" was selected by way of example for both the first lower transverse threads and the second lower transverse threads. See, e.g. the second lower transverse thread 182 and the second lower transverse thread 184, at which the binding positions x, arranged adjacently to each other, are respectively arranged offset to the left by three lower longitudinal threads 112-114 and 113-115, respectively. It is comprehensible, that a different pitch might be selected or that the binding positions may be arranged offset in an irregular manner.

As can be seen in FIGS. 3 and 4, the ratio of first lower transverse threads I to second lower transverse threads II in the lower weave repeat may be, for example 1:1, e.g. at a directly alternating arrangement in longitudinal direction L, i.e. at a recurring sequence in longitudinal direction L of one first lower transverse thread I and a successive second lower transverse thread II. It is comprehensible, that a different ratio might be selected, e.g. a ratio of 1:2 or 2:1.

According to various embodiments, the first lower transverse threads I may have thermosetting properties different from the second lower transverse threads II, e.g. a different shrinking behavior than the second lower transverse threads. This is made possible by the different binding of first and second lower transverse threads, which can be selected such, that it at least partially compensates the different thermosetting properties.

According to various embodiments, the first lower transverse threads I may have a diameter different from the second lower transverse threads II, and/or the first lower transverse threads I may be made from a material different from the second lower transverse threads II, and/or the first lower transverse threads I and the second lower transverse threads II may be treated differently with influence on their thermosetting behavior, e.g. differently mechanically treated, e.g. differently stretched.

According to various embodiments, the screen can be formed as a synthetic fabric, e.g. as a thermoset synthetic fabric. In the synthetic fabric at least the lower transverse threads 181-200, e.g. also the longitudinal threads 101-110 and transverse threads 121-180 extending in the upper fabric layer (see below as well as FIG. 2) and/or the lower longitudinal threads 111-120, are formed as synthetic threads.

A respective of the lower transverse threads 181-200 can, e.g. be made of polyamide or polyester. For example, the first lower transverse threads I can be made of one of polyamide and polyester, wherein the second lower transverse threads II are made of the other one of polyamide and polyester. Alternatively, the first lower transverse threads I may, for example, be made of a first polyamide, wherein the second lower transverse threads II are made of another polyamide. Further alternatively, the first lower transverse threads I and the second lower transverse threads II can, for example, be made of the same synthetic material (e.g. polyamide 6.6), wherein the first lower transverse threads I and the second lower transverse threads II are stretched differently with influence on their thermosetting behavior. Further alternatively, the first lower transverse threads I and the second lower transverse threads II can, for example, be made of the same synthetic material (e.g. polyamide 6.6), wherein the first lower transverse threads I and the second lower transverse threads II have different diameters.

Figure 2:
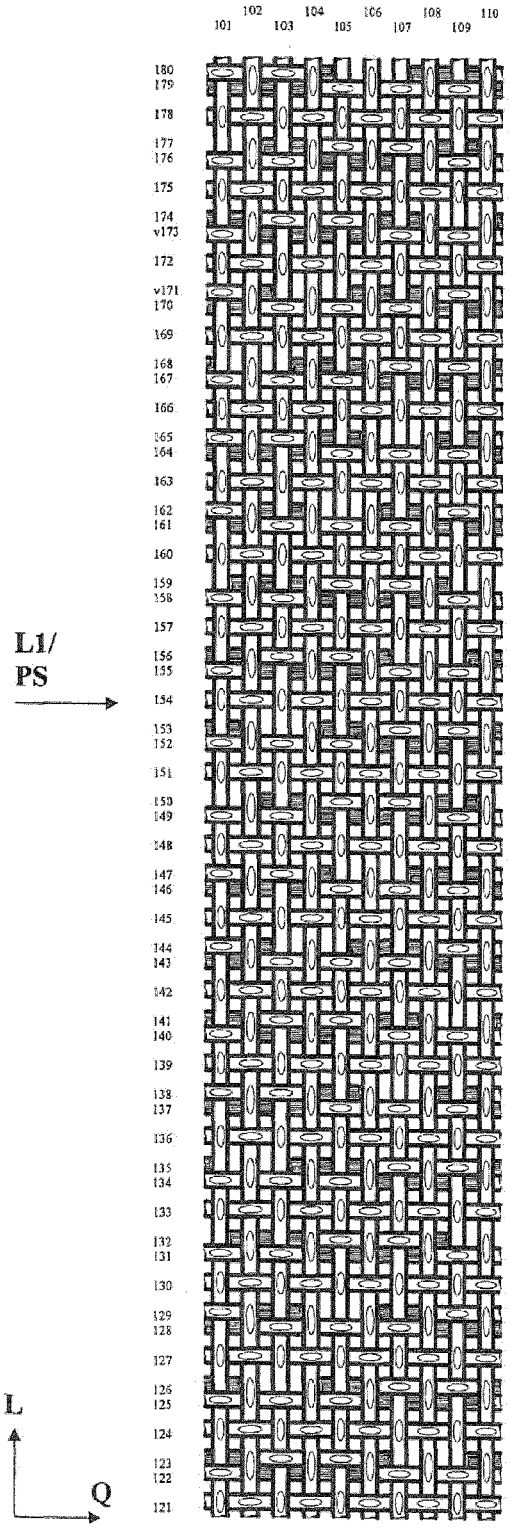

As can be seen in the FIGS. 1*b*) and 1*d*) as well as FIGS. 2 and 3, the screen can, for example, be formed as a transverse thread-bound multi-layer fabric in which the binding threads are formed by transverse threads. See binding transverse threads 123, 126, 129, etc. It is to be understood, however, that also a different or additional form of layer binding might be selected, e.g. by using binding longitudinal threads.

As shown in the FIGS. 2 and 3, the binding threads can, for example, be formed from transverse threads 123, 126, . . . extending in the upper fabric layer L1 and, on the one hand contributing to forming/completing the upper weave and, on the other hand, descending in sections into the lower fabric layer L2 to extend under at least one (here by way of example exactly one; see FIG. 3) lower longitudinal thread and thereby bind the lower fabric layer to the upper fabric layer.

As shown in the FIGS. 3 and 4, the lower weave repeat can, for example, contain exactly 10 lower longitudinal threads 111-120. In the above described arrangement of the binding positions, this may, according to various embodiments, lead to a long transverse thread-float on the running side; see FIG. 4.

As shown further in the FIGS. 3 and 4, in the lower weave repeat the ratio of lower transverse threads 181-200 to lower longitudinal threads 111-120 can, for example, be 2:1 or exactly 20:10, respectively. It is comprehensible that a different suitable ratio might be selected. The comparatively high number of lower transverse threads (which form the transverse thread-floats arranged on the running side) can, according to various embodiments, lead to an especially stable, durable running side and a sufficient and suitable number of lower transverse threads is provided, to which, for example, the different materials and/or different diameters can be distributed.

As shown in FIG. 3, in the lower weave repeat, seen in a longitudinal direction L, always a transverse thread-binding to the upper fabric layer L1 can be provided, for example, between two transverse threads 181-200 arranged immediately next to each other, here by way of example, formed by exactly one binding transverse thread 123, 126, . . . extending temporarily in the lower fabric layer and thereby extending under at least one (here, by way of example, exactly one) longitudinal thread 111-120. For example, between the lower transverse threads 181 and 182 a transverse thread binding to the upper fabric layer L1 is provided, which is formed by the binding transverse thread 123 extending temporarily in the lower fabric layer L2 and thereby extending under the lower longitudinal thread 118. According to various embodiments, the upper and the lower fabric layer can thus be connected to each other consistently. It is comprehensible, that the transverse thread bindings may be distributed on the lower fabric layer in a different way.

According to various embodiments, the diameter of the lower transverse threads 181-200 can, e.g. be larger than the diameter of the transverse threads 121-180 extending in the upper fabric layer and/or be larger than the diameter of the binding threads 123, 126, . . . , and/or the diameter of the lower transverse threads 181-200 can be larger than the diameter of the lower longitudinal threads 111-120, and/or the lower transverse threads 181-200 may have the largest diameter of all threads in the total weave. According to various embodiments, the lower transverse threads can thus be formed robustly and durably, whereas the paper side may be formed finely. According to various embodiments, the binding transverse threads may thus be shielded by lower transverse threads from the wear-causing components of the paper machine. According to various embodiments, an interference/interruption of the lower binding/weave structure by the binding transverse threads may thus at least be reduced.

The upper fabric layer L1 is not limited to a certain configuration and, depending on the intended purpose, a suitable/appropriate paper side may be selected. With reference to FIG. 2, a possible configuration example is described below, which, however, is in no way to be understood as limiting. In other words, the running side according to FIGS. 3 and 4 (as well as the running side according to FIG. 5 or the running side according to FIG. 6) can also be combined with a different paper side or a different upper fabric layer and be attached/bound thereto.

As shown in FIG. 2, the upper fabric layer L1 can, e.g. be formed from a plurality of uniformly structured upper weave repeats (e.g. consist thereof) each of which comprising (e.g. consisting of):

- upper longitudinal threads 101-110 extending exclusively in the upper fabric layer L1 (here, by way of example, in a number of 10 threads),
- upper transverse threads 121, 122, 124, 125, . . . , (here, by way of example, in a number of 40 threads), extending exclusively in the upper fabric layer and being interwoven with the upper longitudinal threads 101-110, thereby partially forming the upper weave, and
- binding transverse threads 123, 126, . . . , (here, by way of example in a number of 20 threads) that, on the one hand, complete the upper weave and, on the other hand, descend in sections into the lower fabric layer L2 to extend under at least one of the longitudinal threads extending in the lower fabric layer and thereby bind the lower fabric layer to the upper fabric layer.

As shown in the FIGS. 2 and 3, the lower repeat and the upper repeat may be, for example, formed the same size, so that the total repeat comprises exactly one upper repeat and exactly one lower repeat. It is, however, also conceivable that the upper repeat is, e.g. smaller than the lower repeat. For example, the running side may be formed as a genuine plain weave (without using functional pairs), i.e. with an upper repeat of only 2 upper longitudinal threads and 2 upper transverse threads, wherein the running side is bound to the lower fabric layer by means of separate binding threads. In this case the total repeat would comprise one lower weave repeat and a plurality of upper weave repeats. It is also conceivable that the upper repeat is, e.g. larger than the lower repeat.

As shown in FIGS. 2 and 3 (see also FIGS. 1*a*)-1*d*)), the fabric may, for example, have a total repeat, in which the ratio of upper longitudinal threads 101-110 to lower longitudinal threads 111-120 is 1:1, e.g. exactly 10:10.

As shown in FIG. 2, the upper fabric layer L1 can, for example, be formed with a plain weave that, e.g. is formed from upper longitudinal threads 101-110 being interwoven with upper transverse threads 121, 124, . . . , as well as with imaginary uninterrupted upper transverse threads, provided by functional transverse thread pairs 122, 123; 125, 126; . . . , wherein, for example in longitudinal direction L one upper transverse thread and one functional transverse thread pair are arranged alternatingly behind each other.

Figure 5:
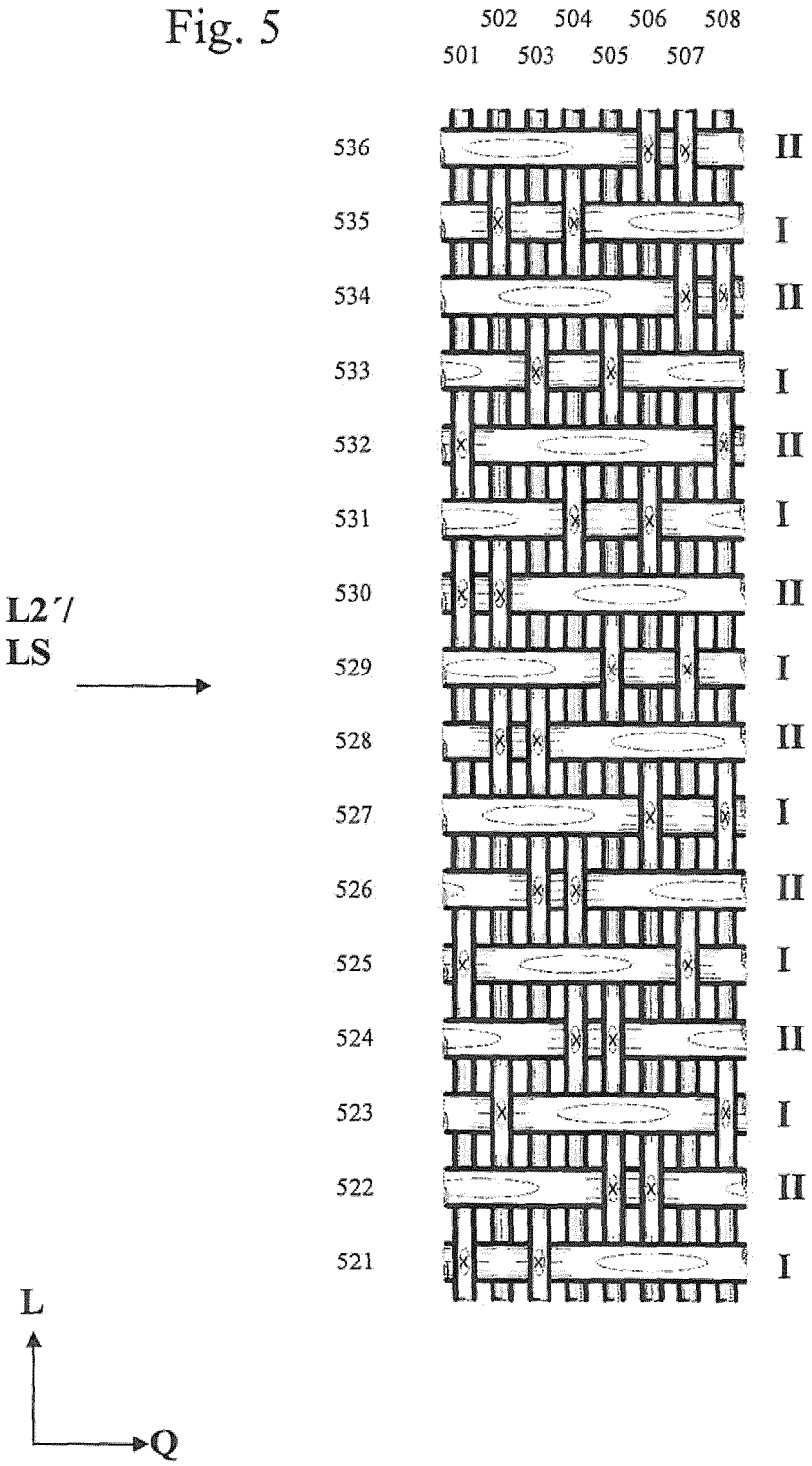
FIG. 5 shows—in a representation corresponding to FIG. 4—the lower weave repeat (especially its running side) of a paper machine screen, especially sheet forming screen (or forming screen), formed as a multi-layer fabric according to a second embodiment (so-called 8-shaft configuration).

FIG. 5 shows the lower weave repeat of a paper machine screen, especially sheet forming screen (or forming screen respectively) formed as a multi-layer fabric according to a second embodiment (so-called 8-shaft configuration).

The (not shown) paper side or upper fabric layer of the paper machine screen according to the second embodiment can, as described for the first embodiment, be selected appropriately and be, e.g. formed with a plain weave (e.g. with a plain weave formed following the example set by FIG. 2). A different appropriate upper fabric layer or upper weave can, however, be provided.

The binding of the (not shown) upper fabric layer to the lower fabric layer can, analogously to the first embodiment, be realized by means of binding transverse threads. The binding or connecting, respectively, of the two fabric layers can, however, also be performed differently, e.g. by means of separate binding threads and/or binding longitudinal threads.

Thus, only the lower fabric layer L2' and its lower weave repeat are described in detail below. Emphasize is being put on the differences to the first embodiment, in parts omitting repetition of identical or similar aspects with reference to the first embodiment.

The lower fabric layer L2' of the screen according to the second embodiment is formed by (and, e.g. consists of) a plurality of uniformly structured lower weave repeats, each of which comprising longitudinal threads 501-508 extending in the lower fabric layer L2' and lower transverse threads 521-536 (e.g. the respective repeat consists of the mentioned threads), extending exclusively in the lower fabric layer L2' and being interwoven with the longitudinal threads 501-508 extending in the lower fabric layer.

As shown in FIG. 5, the longitudinal threads extending in the lower fabric layer can be formed, e.g. as lower longitudinal threads 501-508 extending exclusively in the lower fabric layer L2' and being, for example, interwoven with the lower transverse threads 521-538 thereby completely forming the lower weave. In the following, reference is thus made to lower longitudinal threads even though the longitudinal threads 501-508 extending in the lower fabric layer may be configured differently.

Analogously to the first embodiment, in the lower weave repeat the lower transverse threads 521-536 are respectively bound into the lower fabric layer each by exactly two lower longitudinal threads as a first longitudinal thread extends under the respective lower transverse thread at a first binding position "x" and a second longitudinal thread extends under the respective lower transverse thread at a second binding position "x". As FIG. 5 shows a bottom view of the lower fabric layer, here both "binding longitudinal threads" of each lower transverse thread extend over the allocated transverse thread.

Also analogously to the first embodiment, in the respective lower weave repeat the lower transverse threads 521-536 are bound into the lower fabric layer differently, thereby forming first lower transverse threads I and second lower transverse threads II, wherein at the first lower transverse threads I a shortest distance in transverse direction Q between the first and the second binding position x is larger than at the second lower transverse threads II.

As shown in FIG. 5, the different binding results in the first lower transverse threads I forming a shorter float on the running side LS than the second lower transverse threads II. Cf., for example, the float of thread 530 to the float of thread 521.

As can be seen in FIG. 5, the larger shortest distance in transverse direction Q at the first lower transverse threads I can, e.g. be achieved by the fact that at the first lower transverse threads between the first and the second binding position x at least one longitudinal thread extending over the lower transverse thread (in a plan view onto the top side of the lower fabric layer) more is arranged than at the second lower transverse threads II, for example exactly one longitudinal thread more or one additional thread, respectively.

As can further be seen in FIG. 5, at the first lower transverse threads I the shortest distance in a transverse direction Q—expressed by lower longitudinal threads 501-508 positioned therebetween, extending over the lower transverse thread—is, for example, exactly one longitudinal thread, wherein at the second lower transverse threads II the shortest distance—expressed by lower longitudinal threads 501-508 positioned therebetween, extending over the lower transverse thread—is zero longitudinal threads (respectively in a plan view onto the top side of the lower fabric layer).

This means, in the lower weave repeat at the first lower transverse threads I respectively exactly one lower longitudinal thread 501-508 extending over the lower transverse thread can be arranged between the first and the second binding position x, wherein in the lower weave repeat at the second lower transverse threads II between the first and the second binding position x no longitudinal thread 501-508 extending over the lower transverse threads is arranged respectively, so that both binding positions are located immediately adjacent to each other (respectively in the plan view onto the top side of the lower fabric layer).

As can further be seen in FIG. 5, the different shortest distance in transverse direction Q can, e.g. be achieved by the fact that the first lower transverse threads I are introduced/interwoven into the lower fabric layer with a course different from the second lower transverse threads II with respect to the lower longitudinal threads 501-508, wherein all of the first lower transverse threads I in the lower weave repeat have, in principle, the same course and only the arrangement of the binding positions x in transverse direction Q varies, and wherein all of the second lower transverse threads II in the lower weave repeat have, in principle, the same course and only the arrangement of the binding positions x in transverse direction Q varies.

As can be seen in FIG. 5, the course of the first lower transverse threads I with respect to the lower longitudinal threads (in the plan view onto the top side of the lower fabric layer) can, e.g. be as follows: under five successive longitudinal threads, over one longitudinal thread, under one longitudinal thread and over one longitudinal thread. The course of the second lower transverse threads II with respect to the lower longitudinal threads (in the plan view onto the top side of the lower fabric layer) can, e.g. be as follows: under six successive longitudinal threads and over two successive longitudinal threads.

As can be seen in FIG. 5, in the lower weave repeat the binding positions x of a respective first lower transverse thread I can be arranged, for example, offset in a transverse direction to the binding positions of the two first lower transverse threads adjacently arranged in longitudinal direction L, for example, offset to the binding positions of every other first lower transverse thread of the lower weave repeat. See, for example, the first lower transverse thread 523 and the two first lower transverse threads 521 and 525 arranged adjacently in longitudinal direction L. The same holds true for the second lower transverse threads II.

As can further be seen in FIG. 5, in the lower weave repeat the binding positions x of two first lower transverse threads I, arranged directly next to each other in longitudinal direction L, can, for example, be arranged offset in a transverse direction always by the same amount of longitudinal threads 501-508 extending in the lower fabric layer and in the same direction. The same holds true for the second lower transverse threads. In FIG. 5, for both, the first lower transverse threads and the second lower transverse threads, a pitch of "one lower longitudinal thread to the left" has been selected (in the plan view onto the lower fabric layer thus a pitch of "one lower longitudinal thread to the right").

As can further be seen in FIG. 5, the ratio of first lower transverse threads I to second lower transverse threads II in the lower weave repeat, analogous to the first embodiment, can be, for example, 1:1, e.g. with a directly alternating arrangement in longitudinal direction L.

Analogously to the first embodiment, according to various embodiments, the first lower transverse threads I may have thermosetting properties different from the second lower transverse threads II, e.g. have a different shrinking behavior compared to the second lower transverse threads.

Analogously to the first embodiment, according to various embodiments, the first lower transverse threads I may have a diameter different from the second lower transverse threads II, and/or the first lower transverse threads I may be made of a material different from the second lower transverse threads II, and/or the first lower transverse threads I and the second lower transverse threads II may be treated differently with influence on their thermosetting behavior, e.g. mechanically treated differently, e.g. stretched differently.

Analogously to the first embodiment, the screen can, according to various embodiments, be formed as a synthetic fabric, e.g. as a thermoset synthetic fabric. In the synthetic fabric, at least the lower transverse threads 521-536, e.g. also the lower longitudinal threads 501-508, are formed as synthetic threads.

As shown in FIG. 5, the lower weave repeat may, for example, contain exactly 8 lower longitudinal threads 501-508; a so-called 8-shaft configuration, because the respective course of lower transverse threads is repeated after 8 lower longitudinal threads.

As shown further in FIG. 5, in the lower weave repeat the ratio of lower transverse threads 521-536 to lower longitudinal threads 501-508 may, for example be 2:1 or be exactly 16:8, respectively.

Analogously to the first embodiment, according to various embodiments, the diameter of the lower transverse threads 521-536 can, for example, be larger than the diameter of the transverse threads extending in the upper fabric layer (not shown) and/or be larger than the diameter of the binding threads (also not shown), and/or the diameter of the lower transverse threads 521-536 can be larger than the diameter of the lower longitudinal threads 501-508, and/or the lower transverse threads 501-508 can, in the total repeat, have the largest diameter of all threads.

Figure 6:
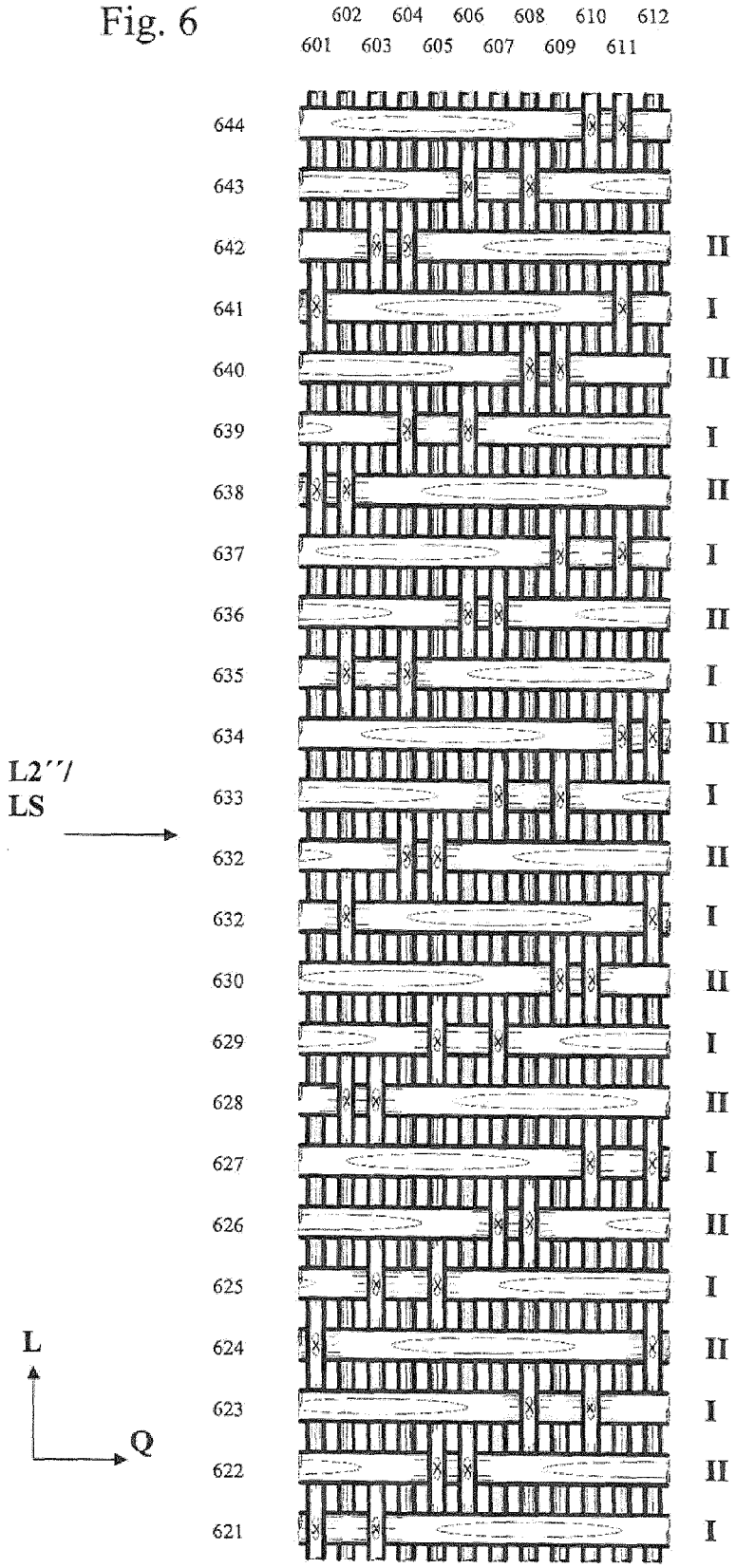
FIG. 6—in a representation corresponding to FIG. 4—shows the lower weave repeat (especially its running side) of a paper machine screen, especially sheet forming screen (or forming screen), formed as a multi-layer fabric according to a second embodiment (so-called 12-shaft configuration).

FIG. 6 shows the lower weave repeat of a paper machine screen formed as a multi-layer fabric according to a third embodiment (so-called 12-shaft configuration).

Regarding the upper fabric layer and its binding to the lower fabric layer, the information given in the description of the second embodiment shall apply. Thus, only the lower fabric layer L2" and its lower weave repeat are described in detail below. Emphasize is being put on the differences to the first and second embodiment, in parts omitting repetition of identical or similar aspects with reference to the first/second embodiment.

The lower fabric layer L2" of the screen according to the third embodiment is formed by (and, e.g. consists of) a plurality of uniformly structured lower weave repeats, each of which comprising longitudinal threads 601-612 extending in the lower fabric layer L2" and lower transverse threads 621-644 (e.g. the respective repeat consists of the mentioned threads), extending exclusively in the lower fabric layer L2" and being interwoven with the longitudinal threads 601-612 extending in the lower fabric layer.

As shown in FIG. 6, the longitudinal threads extending in the lower fabric layer can be formed, e.g. as lower longitudinal threads 601-612 extending exclusively in the lower fabric layer L2" and being, for example, interwoven with the lower transverse threads 621-644 thereby completely forming the lower weave. In the following, reference is thus made to lower longitudinal threads even though the longitudinal threads 621-644 extending in the lower fabric layer may be configured differently.

The lower transverse threads 621-644 are, analogously to the first and second embodiment, each bound twice into the lower fabric layer in the lower weave repeat, i.e. by exactly two lower longitudinal threads.

Also analogously to the first and second embodiment, in the respective lower weave repeat the lower transverse threads 621-644 are bound into the lower fabric layer differently, thereby forming first lower transverse threads I and second lower transverse threads II, wherein at the first lower transverse threads I a shortest distance in transverse direction Q between the first and the second binding position x is larger than at the second lower transverse threads II.

As shown in FIG. 6, the different binding has the result that the first lower transverse threads I form a shorter float on the running side LS than the second lower transverse threads II. Cf., e.g. the float of thread 638 with the float of thread 621.

As can be seen in FIG. 6, in the lower weave repeat at the first lower transverse threads I between the first and the second binding position x, e.g. exactly one lower longitudinal thread 601-612, extending over the lower transverse thread, can be arranged respectively, wherein in the lower weave repeat at the second lower transverse threads II between the first and the second binding position x no lower longitudinal thread 601-612, extending over the lower transverse thread, is arranged respectively so that both binding positions are located immediately adjacent to each other (respectively in the plan view onto the top side of the lower fabric layer).

As can further be seen in FIG. 6, the different shortest distance in transverse direction Q can, e.g. be achieved by the fact that the first lower transverse threads I are introduced/interwoven into the lower fabric layer with a course different from the second transverse threads II with respect to the lower longitudinal threads 601-612, wherein all of the first lower transverse threads I in the lower weave repeat have, in principle, the same course and only the arrangement of the binding positions x in transverse direction Q varies, and wherein all of the second lower transverse threads II in the lower weave repeat have, in principle, the same course and only the arrangement of the binding positions x in transverse direction Q varies.

As can be seen in FIG. 6, the course of the first lower transverse threads I with respect to the lower longitudinal threads (in the plan view onto the top side of the lower fabric layer) can, for example be as follows: under nine successive lower longitudinal threads, over one longitudinal thread, under one longitudinal thread, and over one longitudinal thread. For example the course of the second lower transverse threads II with respect to the lower longitudinal threads (in the plan view onto the top side of the lower fabric layer) can be as follows: under ten successive longitudinal threads and over two successive longitudinal threads.

As can be seen in FIG. 6, in the lower weave repeat, the binding positions x of a respective first lower transverse thread I can, for example, be offset in a transverse direction to the binding positions of the two first lower transverse threads adjacently arranged in longitudinal direction L, e.g. offset to the binding positions of every other first lower transverse thread of the lower weave repeat. See, e.g. the first lower transverse thread 623 and the two first lower transverse threads 621 and 625 arranged adjacently in longitudinal direction L. The same holds true for the second lower transverse threads II.

As can further be seen in FIG. 6, in the lower weave repeat the binding positions x of two first lower transverse threads I, arranged directly next to each other in longitudinal direction L, can be arranged offset in a transverse direction always by the same amount of longitudinal threads 601-612 extending in the lower fabric layer and in the same direction. The same holds true for the second lower transverse threads. In FIG. 6, a pitch of "five lower longitudinal threads to the left" was selected by way of example for both the first lower transverse threads and the second lower transverse threads (in the plan view onto the lower fabric layer thus a pitch of "five lower longitudinal threads to the right").

As can further be seen in FIG. 6, the ratio of first lower transverse threads I to second lower transverse threads II in the lower weave repeat can, analogously to the first and second embodiment, e.g. be 1:1, for example with a direct alternating arrangement in longitudinal direction L.

Analogously to the first and second embodiment, the first lower transverse threads I may, according to various embodiments, have thermosetting properties different from the second lower transverse threads II, e.g. a different shrinking behavior than the second lower transverse threads.

Analogously to the first and second embodiment, the first lower transverse threads I may, according to various embodiments, have a diameter different from the second lower transverse threads II, and/or the first lower transverse threads I may be made of a material different from the second lower transverse threads II, and/or the first lower transverse threads I and the second lower transverse threads II may, with influence on their thermosetting behavior, be treated differently, e.g. differently mechanically treated, e.g. differently stretched.

Analogously to the first and second embodiment, the screen may, according to various embodiments, be formed as a synthetic fabric, e.g. as thermoset synthetic fabric. In the synthetic fabric at least the lower transverse threads 621-644, e.g. also the lower longitudinal threads 601-612 are formed as synthetic threads.

As shown in FIG. 6, the lower weave repeat may, for example, comprise exactly 12 lower longitudinal threads 601-612; so-called 12-shaft configuration, in which the respective course of transverse threads is repeated after 12 lower longitudinal threads, i.e. the respective transverse thread repeats, in the not-shown lower repeat arranged in transverse direction to the right of the lower repeat shown, its course shown in FIG. 6.

As shown further in FIG. 6, in the lower weave repeat the ratio of lower transverse threads 621-644 to lower longitudinal threads 601-612 may, for example, be 2:1 or exactly 24:12, respectively.

Analogously to the first and second embodiment, according to various embodiments, the diameter of the lower transverse threads 621-644 can, for example, be larger than the diameter of the transverse threads extending in the upper fabric layer (not shown) and/or be larger than the diameter of the binding threads (also not shown), and/or the diameter of the lower transverse threads 621-644 can be larger than the diameter of the lower longitudinal threads 601-612, and/or the lower transverse threads 621-644 can have the largest diameter of all threads in the total weave.

The invention claimed is:

1. A paper machine screen formed as a multi-layer fabric having an upper fabric layer and a lower fabric layer which are connected to each other by means of binding threads, wherein the lower fabric layer is formed by a plurality of uniformly structured lower weave repeats, each of which comprising:

longitudinal threads extending in the lower fabric layer and lower transverse threads extending exclusively in the lower fabric layer and being interwoven with the longitudinal threads that extend in the lower fabric layer, wherein in the respective lower weave repeat the lower transverse threads are each bound into the lower fabric layer by exactly two longitudinal threads that extend in the lower fabric layer as a first longitudinal thread extends under the respective lower transverse thread at a first binding position and a second longitudinal thread extends under the respective lower transverse thread at a second binding position, and wherein in the respective lower weave repeat the lower transverse threads are bound into the lower fabric layer differently, thereby forming first lower transverse threads and second lower transverse threads, wherein at the first lower transverse threads a shortest distance in transverse direction between the first and the second binding position is larger than at the second lower transverse threads so that the first lower transverse threads (I) form a shorter float on the running side than the second lower transverse threads.

2. The paper machine screen according to claim 1, wherein the larger shortest distance in transverse direction at the first lower transverse threads is achieved by the fact that at the first lower transverse threads between the first and the second binding position at least one longitudinal thread more, extending in the lower fabric layer and extending over the lower transverse thread, is arranged than at the second lower transverse threads, and/or wherein at the first lower transverse threads the shortest distance in transverse direction—expressed by longitudinal threads positioned therebetween, extending in the lower fabric layer and extending over the lower transverse thread—is one longitudinal thread or two longitudinal threads, and wherein at the second lower transverse threads the shortest distance—expressed by longitudinal threads positioned therebetween, extending in the lower fabric layer and extending over the lower transverse thread—is zero longitudinal threads or one longitudinal thread, and/or wherein in the lower weave repeat at the first lower transverse threads respectively exactly one longitudinal thread, extending in the lower fabric layer and extending over the lower transverse thread, is arranged between the first and the second binding position, and wherein in the lower weave repeat at the second lower transverse threads between the first and the second binding position no longitudinal thread, extending in the lower fabric layer and extending over the lower transverse thread, is arranged respectively so that both binding positions are located immediately adjacent to each other.

3. The paper machine screen according to claim 1, wherein the different shortest distance in transverse direction is achieved by the fact that the first lower transverse threads are introduced into the lower fabric layer with a course different from the second lower transverse threads with respect to the longitudinal threads extending in the lower fabric layer, wherein all of the first lower transverse threads in the lower weave repeat have, in principle, the same course and only the arrangement of the binding positions in transverse direction varies, and wherein all of the second lower transverse threads in the lower weave repeat have, in principle, the same course and only the arrangement of the binding positions in transverse direction varies.

4. The paper machine screen according to claim 1, wherein in the lower weave repeat the binding positions of a respective first lower transverse thread are arranged offset in a transverse direction to the binding positions of the two first lower transverse threads adjacently arranged in longitudinal direction, and/or wherein in the lower weave repeat the binding positions of a respective second lower transverse thread are arranged offset in a transverse direction to the binding positions of the two second lower transverse threads adjacently arranged in longitudinal direction, and/or wherein in the lower weave repeat the binding positions of two first lower transverse threads, arranged directly next to each other in longitudinal direction, are arranged offset in a transverse direction always by the same amount of longitudinal threads extending in the lower fabric layer and in the same direction, and/or wherein in the lower weave repeat the binding positions of two second lower transverse threads, arranged next to each other in longitudinal direction, are arranged offset in a transverse direction always by the same amount of longitudinal threads extending in the lower fabric layer and in the same direction.

5. The paper machine screen according to claim 1, wherein the ratio of first lower transverse threads to second lower transverse threads in the lower weave repeat is 1:1 or 2:1 or 1:2.

6. The paper machine screen according to claim 1, wherein the first lower transverse threads have, relative to the second lower transverse threads, different thermosetting properties and/or wherein the first lower transverse threads have a cross-sectional shape and/or a diameter different from the second lower transverse threads and/or, wherein the first lower transverse threads are made of a material different from the material of the second lower transverse threads and/or wherein the first lower transverse threads and the second lower transverse threads are treated differently with influence on their thermosetting behavior.

7. The paper machine screen according to claim 1, formed as a synthetic fabric with at least the lower transverse threads being formed as synthetic threads.

8. The paper machine screen according to claim 7, wherein a respective of the lower transverse threads is made of polyamide or polyester.

9. The paper machine screen according to claim 1, formed as transverse thread-bound multi-layer fabric, in which the binding threads are formed from transverse threads, and/or wherein the binding threads are formed from transverse threads extending in the upper fabric layer and, on the one hand, contributing to forming the upper weave and, on the other hand, descending in sections into the lower fabric layer to extend under at least one of the longitudinal threads extending in the lower fabric layer and thereby bind the lower fabric layer to the upper fabric layer.

10. The paper machine screen according to claim 1, wherein the longitudinal threads extending in the lower fabric layer are formed as lower longitudinal threads extending exclusively in the lower fabric layer.

11. The paper machine screen according to claim 1, wherein the lower weave repeat comprises at least 8 longitudinal threads extending in the lower fabric layer, and/or wherein in the lower weave repeat the ratio of lower transverse threads to longitudinal threads extending in the lower fabric layer is 2:1, and/or wherein in the lower weave repeat, when seen in a longitudinal direction, always a transverse thread-binding to the upper fabric layer is provided between two lower transverse threads arranged immediately next to each other.

12. The paper machine screen according to claim 1, wherein the diameter of the lower transverse threads is larger than the diameter of the transverse threads extending in the upper fabric layer and/or larger than the diameter of the binding threads, and/or wherein the diameter of the lower transverse threads is larger than the diameter of the longitudinal threads extending in the lower fabric layer and/or wherein the lower transverse threads have the largest diameter in the total repeat of all threads.

13. The paper machine screen according to claim 1, wherein the upper fabric layer is formed from a plurality of uniformly structured upper weave repeats, each of which comprising:

upper longitudinal threads extending exclusively in the upper fabric layer, upper transverse threads extending exclusively in the upper fabric layer and being interwoven with the upper longitudinal threads, thereby partially forming the upper weave, and binding transverse threads that, on the one hand, complete the upper weave and, on the other hand, descend in sections into the lower fabric layer to extend under at least one of the longitudinal threads extending in the lower fabric layer and thereby bind the lower fabric layer to the upper fabric layer.

14. The paper machine screen according to claim 13, wherein the fabric has a total repeat in which the ratio of upper longitudinal threads to lower longitudinal threads is 1:1.

15. The paper machine screen according to claim 1, wherein the upper fabric layer is formed with a plain weave.

* * * * *